United States Patent [19]

Dawson et al.

[11] Patent Number: 4,947,760

[45] Date of Patent: Aug. 14, 1990

[54] ARTICULATED FLAT CAR

[75] Inventors: Richard W. Dawson; Ronald P. Sellberg, both of Naperville, Ill.

[73] Assignee: Trailer Train Company, Chicago, Ill.

[21] Appl. No.: 394,285

[22] Filed: Aug. 15, 1989

Related U.S. Application Data

[63] Continuation of Ser. No. 110,118, Oct. 19, 1987, abandoned.

[51] Int. Cl.[5] ..... B61D 17/00; B60P 3/40; B60P 1/64

[52] U.S. Cl. ..... 105/03; 105/4.1; 105/422; 410/45; 410/53; 410/78

[58] Field of Search ..... 105/3, 4.1, 396, 413, 105/414, 416, 418, 419, 421, 422; 410/45, 52, 54, 11, 76, 77, 78, 90

[56] References Cited

U.S. PATENT DOCUMENTS

| | | | |
|---|---|---|---|
| 2,783,718 | 3/1957 | Cheshire | 105/419 |
| 3,616,764 | 11/1971 | Johnson et al. | 410/71 X |
| 3,721,199 | 3/1973 | Hassenauer | 105/4.1 X |
| 4,750,431 | 6/1988 | Yates et al. | 105/4.1 |

*Primary Examiner*—Andres Kashnikow
*Assistant Examiner*—Virna Lissi Mojica
*Attorney, Agent, or Firm*—Kinzer, Plyer, Dorn, McEachran & Jambor

[57] ABSTRACT

An articulated railroad flat car for single-level loading of containers has five units or platforms. End trucks are disposed at the ends of the two end units and four shared trucks are disposed intermediate the five units at articulated connections between the units. Each unit has a center sill with bolsters at either end mounting outer container retention devices. Alternate units further include intermediate cross-bearers, with intermediate container retention devices mounted on the cross-bearer. This arrangement allows loading of full length containers (40, 45 or 48 feet in length) on each unit and either full length or 20 foot containers on alternative units. A container floor safety system includes a plurality of cross-ties connected to the center sill with longitudinal stringers fastened to the outer ends of the cross-ties. The container floor safety system prevents container lading from falling to the track in the event of a container floor failure.

22 Claims, 4 Drawing Sheets

ARTICULATED FLAT CAR

This is a continuation of copending application Ser. No. 07/110,118 filed on Oct. 19, 1987, now abandoned.

BACKGROUND OF THE INVENTION

This invention relates to railroad flat cars and is particularly directed to an articulated, multiple-unit, single-level container flat car. Such cars typically have two end units or platforms supported at their coupler or outer ends on trucks. The end units adjoin one or more intermediate units with adjacent platforms supported on shared trucks. Connections between the units are made at articulated joints.

Container freight represents a significant portion of railroad tonnage. The advent of containerized lading has resulted in complementary advances in the design of railroad rolling stock. Most significant has been the development of so-called double-stack well cars which have the capability of carrying multiple containers, stacked vertically upon one another, two tiers in height.

While such cars are efficient and provide economy of use, double-stack well cars are not suitable for all forms of rail service. Such cars cannot be used in areas where tunnel or other clearances restrict overall height. In such service it is necessary to utilize cars carrying containers at a single level.

Another advance in railroad rolling stock has been the acceptance and use of multi-platform cars which include shared trucks between adjacent platforms connected by articulated connectors. Such cars minimize the car weight-to-lading ratio and maximize load carrying capability. The peculiarities of container configurations create potential problems of excessive rail loading if indiscriminate intermixing of containers is permitted.

Standard containers currently in use have nominal lengths of 20, 40, 45 and 48 feet. The 20 foot container will be called a short container while the others will be referred to collectively as long containers. It is desirable to be able to intermix containers of different sizes on the same car. This can be done by providing appropriately-located retention means.

Intermixing container sizes, however, can lead to overloading the trucks if care is not taken to avoid it. Current standards limit the gross load on rail for a 70 ton truck to 110,000 lbs. including the weight of the truck, carbody and lading. A standard 70 ton truck weighs about 9,000 lbs. Each shared truck carries half the weight of two adjacent platforms, which is about 14,000 lbs. So an empty platform and truck loads the rail to about 23,000 lbs. That leaves 87,000 lbs. for the containers and their lading.

The specified allowable load of the 20 foot container is 52,912 lbs. The specified load limit of the three long containers is 67,200 lbs. Thus, it can be seen that if two long containers are placed adjacent a shared truck, that truck will carry half the weight of the two containers and the rail load limit will not be exceeded. Similarly, if short and long containers are placed adjacent a shared truck, that truck will carry half of the long container load and all of the short container load, and again the rail load limit will be met. However, if two short containers are placed adjacent a shared truck, that truck takes the full weight of both containers which exceeds the rail load limit. The present invention provides a structure that precludes the overload condition just described yet maximizes the utility and efficiency of a multi-platform configuration.

SUMMARY OF THE INVENTION

The multi-platform, single-level car of the present invention has two end units or platforms, each supported at its coupler end by a truck and at its other end by a shared truck. One or more intermediate units are disposed between the end units, also supported on the shared trucks. Adjacent units are joined by articulated connections at the shared trucks. Each unit has a center sill with laterally-extending bolsters adjacent the ends of the sill. Outer container retention means are located on the ends of the bolsters. Alternate units further include cross-bearers attached to the center sill intermediate the bolsters. The cross-bearers mount intermediate container retention means between the outer retention devices. The outer retention means secure the long containers and outer ends of short containers while the intermediate retention means retain adjacent ends of short containers.

The platforms of the car further include a container floor safety system attached to each unit. The container floor safety system includes a plurality of cross-ties attached to the unit's center sill, with longitudinal stringers connecting the outer ends of the cross-ties. The container floor safety system prevents container lading from falling to the track in the event of a container floor failure.

DETAILED DESCRIPTION OF THE INVENTION

Figure 1:
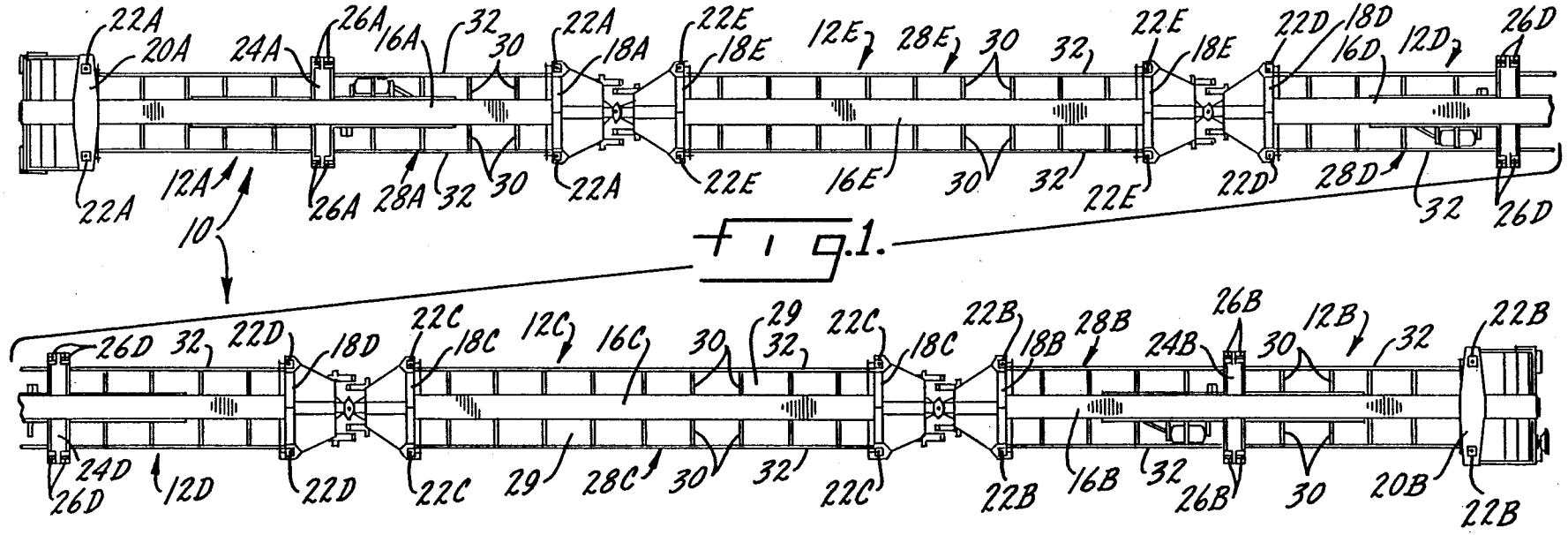
FIG. 1 is a diagrammatic plan view of an articulated flat car of the present invention.

The flat car of the present invention is shown generally at 10 in FIG. 1. In this embodiment the flat car has five units or platforms 12A–12E. The end units 12A and 12B have the outer or coupler ends supported on end trucks 14A and 14B. Intermediate units 12C, 12D and 12E are supported on shared trucks 14C–14F. Articulated joints are located at each shared truck to connect adjacent platforms.

The units 12 have center sills 16A–16E with transversely-mounted bolsters 18A–18E attached near the ends of the sills. The two end units have bolsters 20A and 20B of a slightly different configuration. Outer container retention means 22A–22E are fastened near the ends of the bolsters 18 and 20. The retention means may be known automatic twist locks connecting to container bottom fittings.

Any one of numerous known container securement devices which attach to container bottom securement fittings can be used. The bolsters and retention means are located such that they are spaced to connect to the corner securement fittings found on standard 40 foot containers. Capability exists for carrying longer containers for the reason that typically such longer containers include fittings positioned at the spacing of corner fittings on a 40 foot container. Thus, all such containers can be attached to platforms 12.

Figure 2:
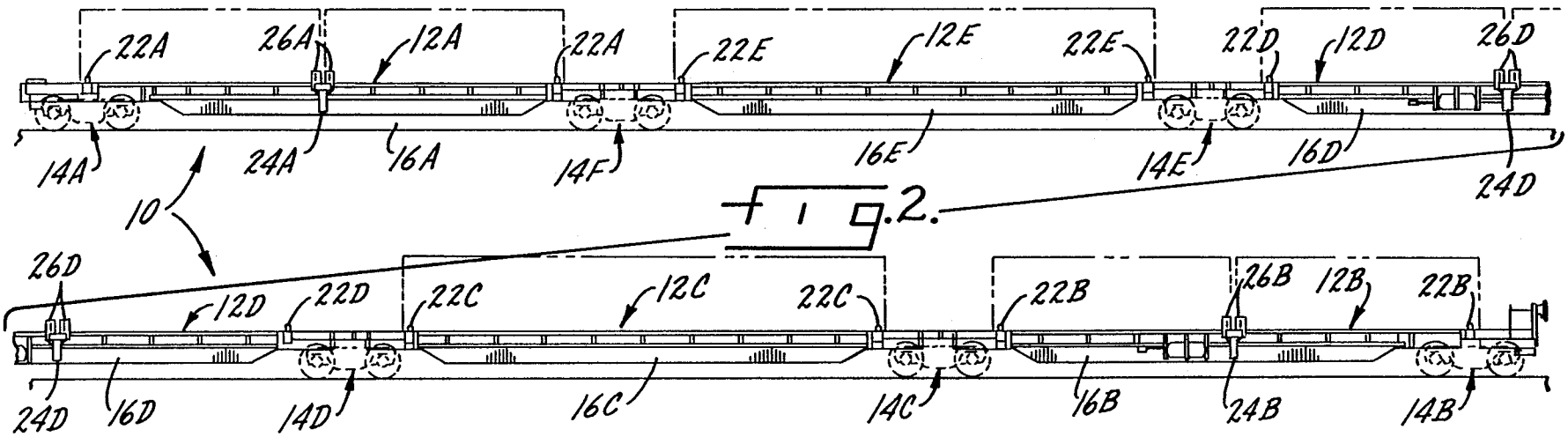
FIG. 2 is a diagrammatic side elevation view of the flat car.

Alternate car units are provided with the capability of loading either one long container or two short containers in closely spaced end-to-end relation as illustrated in phantom lines in FIG. 2. In this embodiment, units 12A, 12B and 12D have cross-bearers 24A, 24B and 24D. The cross-bearers are attached laterally to the center sills 16 approximately midway or centrally between the outer retention means 22. Together the center sill, end bolsters and cross-bearers, if present, comprise the primary car structure.

Intermediate retention means or devices 26A, 26B and 26D are located near the outer edges of the cross-bearers 24. They are spaced relative to the outer retention means such that the outer retention means secure the corner fittings of the far ends of two short containers positioned as illustrated in FIG. 2. The retention means upon cross-bearers 24 retain the corner fittings of the adjacent, closely spaced ends of the short containers. The intermediate retention means may be either passive lateral restraints, or positive securement devices similar to the outer retention means 22. They are arranged to support and retain the adjacent ends of two 20 foot containers which are attached at their opposite ends to the outer retention means.

It will be noted that cross-bearers 24 are provided only on alternate units, in this case the first, third and fifth units. This arrangement precludes retention of two 20 foot containers adjacent a shared truck. As is apparent from FIGS. 1 and 2, retention means for short containers are provided only on one side of a shared truck, and, therefore, a short container can only be secured on one side of a truck. This will prevent the overload condition referred to above.

In accordance with the invention herein disclosed, each unit 12 is equipped with a container floor safety system 28A–28E. The container floor safety system includes a plurality of lateral cross-ties 30 welded to the center sills 16. The outer ends of the cross-ties 30 are connected by longitudinal stringers 32 which extend from one of the bolsters 18 or 20 to a cross-bearer 24. The stringers 32 are bolted to plates on the ends of the cross-ties 30, on the bolsters and on the cross-bearers. The support systems 28 are provided to prevent container lading from falling to the track in the event of a container floor failure. The support systems are positioned on the primary car structure such that they ordinarily do not carry any load. The primary car structure supports the container loads on the retention means, except in the event of a container floor failure. Also, the support systems 28 are attached to the primary car structure in a manner that protects the primary car structure from damage in the event of a container floor failure. That is, the welds and bolted connections between the safety systems and primary car structure will fail before transferring loads from the support systems to the primary car structure sufficient to damage the primary car structure and impair its ability to carry the container loads.

The cross-ties 30 are sized such that the width between stringers 32 is no less than 6½ feet. As illustrated, the cross-ties 30 are spaced longitudinally and sized such that each opening 29 defined by the center sill, stringer 32 and two cross-ties 30 is 8 square feet or less in area. The top surface of the longitudinal stringers 32 is no more than 2 inches below the plane of the support surfaces for the container corner fittings. It should be noted, however, that the spacing of the cross-ties can be varied without departing from the spirit or scope of the invention.

Figure 3A:
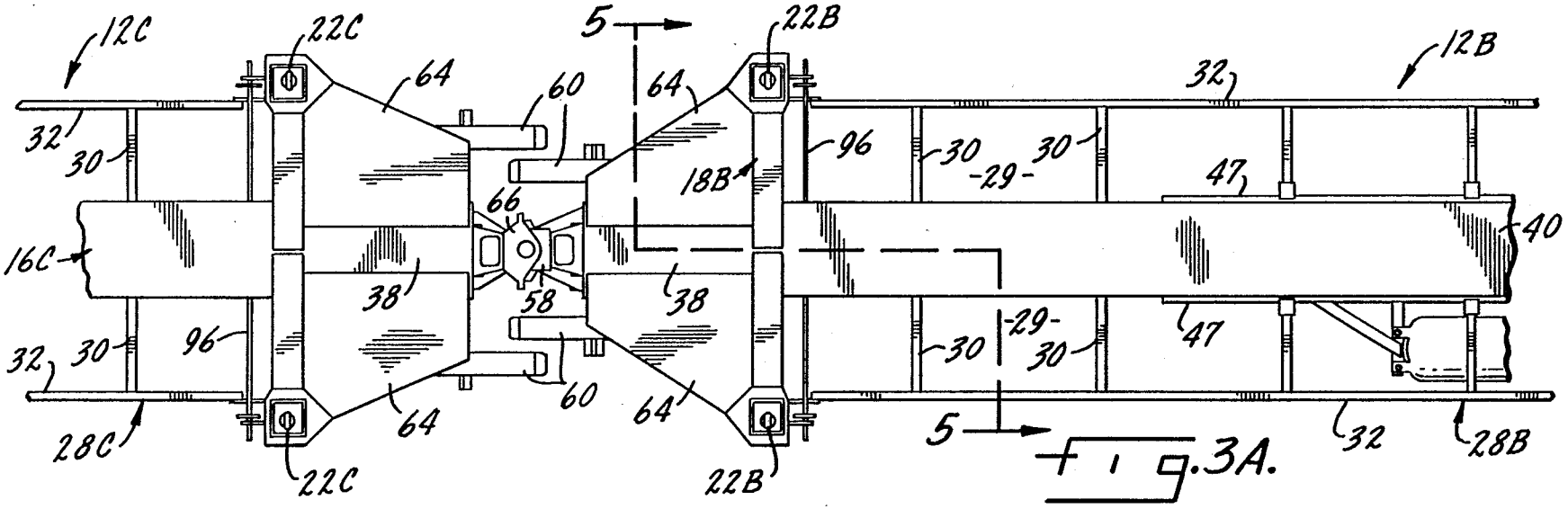
FIGS. 3A and 3B combine to form a plan view of an end unit and a portion of an intermediate unit, on an enlarged scale.
Figure 4A:
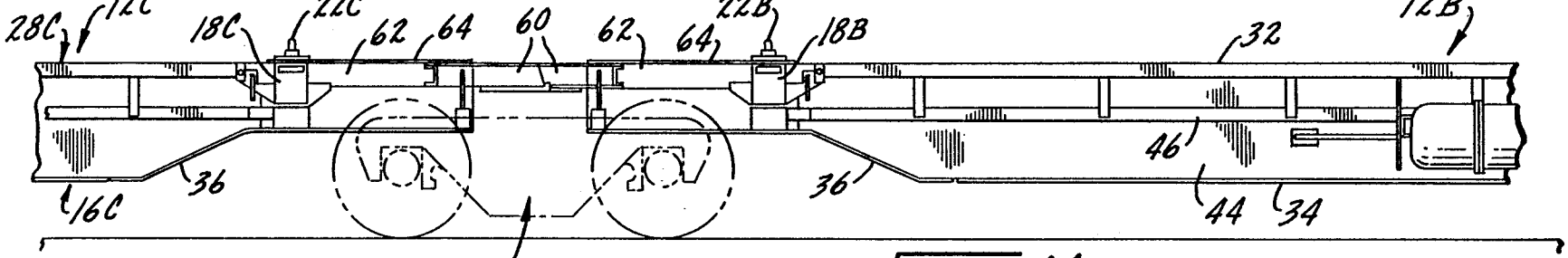
FIGS. 4A and 4B combine to form an enlarged side elevation view of the units shown in FIGS. 3A and 3B.
Figure 3B:
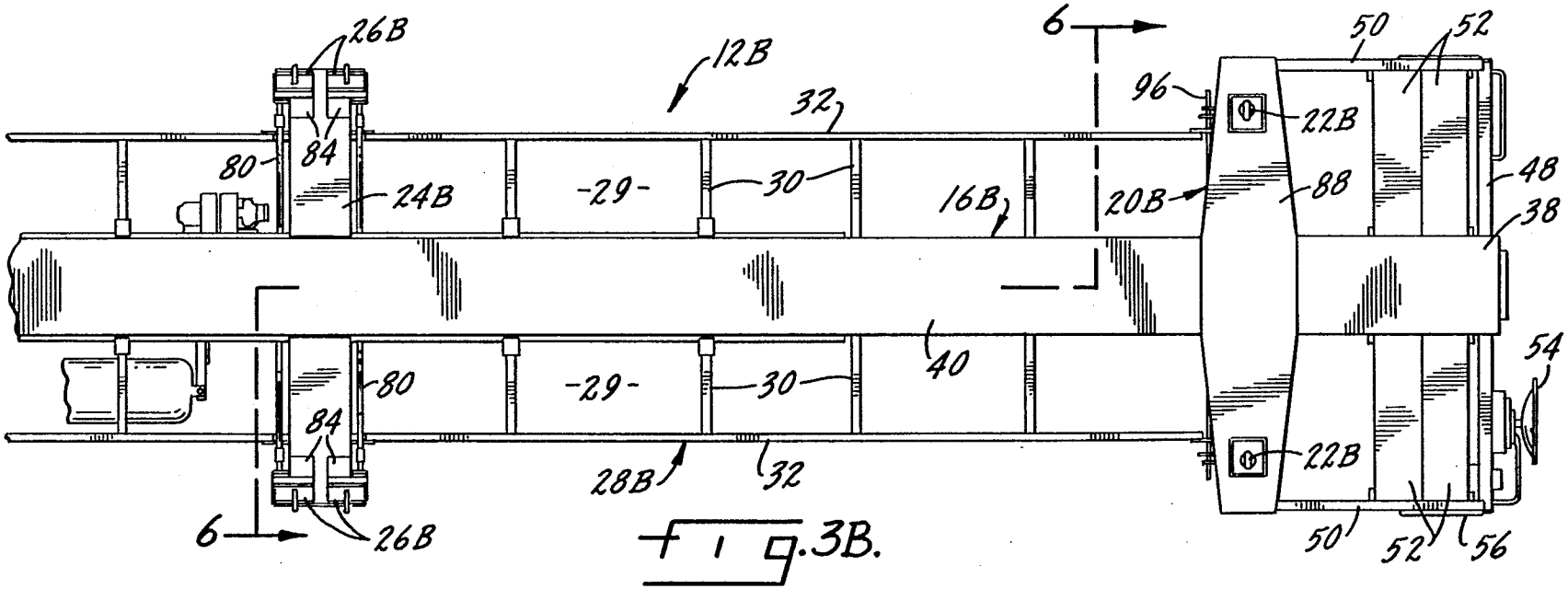
Figure 4B:
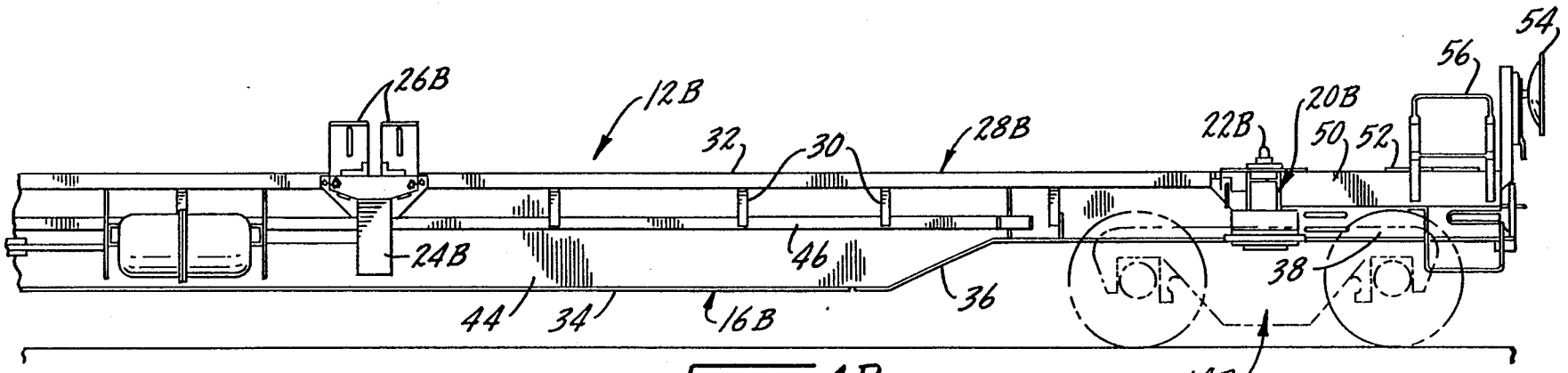

The embodiment of the invention described above is shown in greater detail in the enlarged views of FIGS. 3 and 4. Certain of these details of construction do not form part of the invention but rather are illustrative of an embodiment thereof. FIGS. 3 and 4 show units 12B and a portion of unit 12C. The structures shown are typical of those found throughout the car. The center sill 16B is an elongated box beam having a center section 34, tapered transition sections 36 and end sections 38. The box beam of the center sill is a fabricated (welded) structure. It is formed by top and bottom plates 40 and 42 and webs 44 (see FIG. 5). The box beam is reinforced by internal stiffeners 45A,B. Channel members 46 extend along the webs 44. The top plate is additionally supported by a longitudinal member 47.

The coupler end of the unit 12B includes a fabricated transverse beam 48 fastened to the end section 38 of the center sill. Longitudinal side sill members 50 extend between the bolster 20B and the transverse beam 48. Safety gratings 52 span the frame defined by the sills 50 and center sill end section 38. The usual hand brake 54 and railings 56 may be mounted as shown. It will be understood that a coupler would be mounted on the sill end section in the usual manner.

The articulated connector end of the unit has a male articulated connector 58 attached to the end section 38 of the center sill. A pair of beams 60 also extend from the bolster 18B. Angled beams 62 extend from the bolster 22B toward the beams 60. Cover plates 64 connect beams 60 and 62 to the center sill end section 38. The end of unit 12C is similarly constructed, except that it has a female articulated connector 66.

Figures 5, 6, 7:
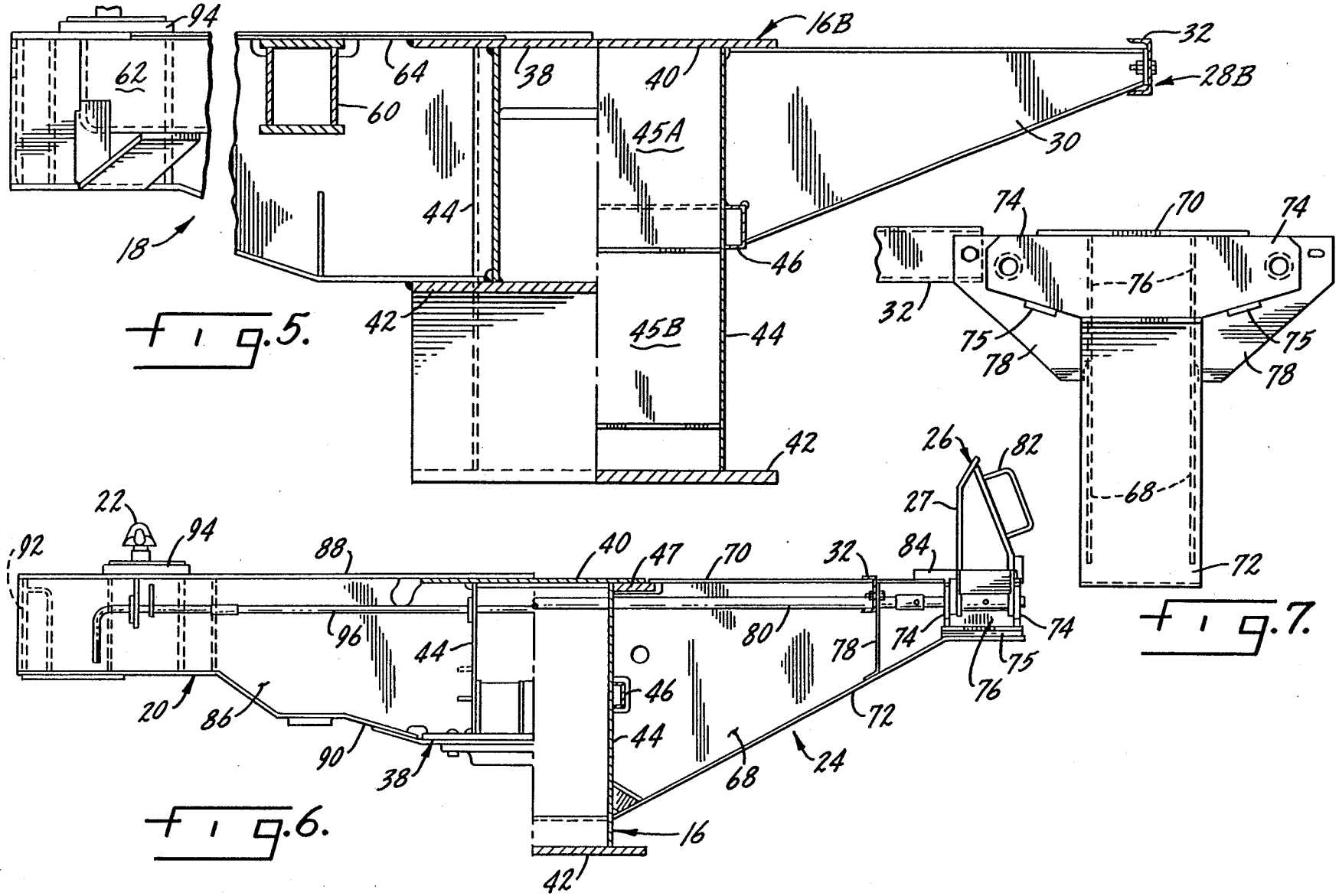
FIG. 5 is a section taken substantially along line 5—5 of FIG. 3A, with parts omitted.
FIG. 6 is a section taken substantially along line 6—6 of FIG. 3B.
FIG. 7 is an end elevation view of a cross-bearer.

FIGS. 5, 6 and 7 show the details of the cross-bearers 24 and bolsters 20. The cross-bearers 24 each have a pair of cross-bearer webs 68 welded to the webs 44 of the center sill 16. Webs 68 are connected to a top plate 70 and a bottom plate 72 to form a beam structure. A pair of brackets 74 are joined by plates 76 and top plate 70 on the ends of the cross-bearer webs 68. Brackets 78 connect stringers 32 to the cross-bearers 24.

Intermediate retention means 26 include laterally aligned pairs of abutments 27 which engage the sides of 20 foot containers adjacent the closely spaced adjacent ends opposite to the ends secured to retention means 22A, 22D and 22B. These pairs are connected by shafts 80 which are rotatably supported on brackets 74 and extend through appropriate openings in center sill 16 and bracket 78. Abutments 27 include handles 82 to permit pivotal movement of the abutments from the elevated position shown in the drawings to a lowered or retracted position. Rotation stops 75 extend between bracket 74 and limit pivotal movement of abutments 27 to the desired retracted position. Retraction of the abutments 27 is necessary when it is desired to load a long container upon platform 12A, 12B or 12D and the containers are of a width which exceed the lateral distance between the aligned abutments.

Retention means 24 further include pads 84 adjacent the abutments to support the corner fittings of twenty-foot containers. Each cross-bearer 24 includes two pairs of abutments 27. A pad 84 is adjacent each abutment.

Thus the ends of two 20 foot containers can be retained upon each cross-bearer.

Retention means 26 provide for restraint of the container ends transversely of the longitudinal extent of the car. As can be appreciated, in certain applications pads 84 may be replaced with locking devices such as locking devices 22 or any other suitable securement means. Such automatic locking devices would serve as the retention means and the portions 27 which only provide lateral restraint could be eliminated.

The bolsters 20 each include a pair of webs 86, and a connecting top plate 88 and bottom plate 90. The outer ends of the top and bottom plates may be joined by a cap 92. The outer retention means 22 are mounted on pads 94. In this embodiment the retention means on either side of the center sill at each bolster may be actuated simultaneously by means of an actuator shaft 96. The bolsters 18 seen in FIG. 5 are similar to the bolsters 20 in strength and configuration except that they are not at the coupler ends and therefore do not require the transverse width associated with end platforms 12A and 12B.

As described above, an overload condition can arise if two adjacent twenty foot containers are loaded on either side of a shared truck. The car of the present invention achieves the objective of preventing overloading while maximizing efficiency and utility by providing a car structure which will not accept twenty foot containers on either side of a shared truck. When in use, twenty foot containers can be loaded only on alternate platforms. In the illustrated embodiment only platforms 12A, 12B and 12D have supports for twenty foot containers. Adjacent platforms 12C and 12E have no provision to support twenty foot containers so they can carry only long containers. So if short containers are carried, they will only be on alternate platforms. This alternate loading requirement prevents overloads while allowing various container sizes to be carried on the same car. Obviously, long containers can be placed on adjacent platforms but this will not overload a shared truck.

It can be seen that the car provides a versatile structure in that it accepts various sizes of containers at a single level. The car has a simple, light-weight structure yet it protects against overloading and derailments due to container floor failure. Moreover, the car provides a container floor support safety system which effectively supports container lading in the event of a failure of the container floor.

An illustrated embodiment of the invention has been shown and described. It will be realized, however, that alternative forms and configurations may be used without departing from the scope of the following claims.

We claim:

1. An articulated flat car for carrying lading containers at a single level comprising first and second platforms supported at one end by end trucks and at the other end by trucks shared with an adjacent platform, and at least one intermediate platform supported on trucks shared with adjacent platforms, said platforms connected by articulated connections between adjacent platforms, said platforms having outer container retention means positioned adjacent opposite ends thereof, and additional container retention means fixedly attached only to alternate platforms intermediate said outer container retention means.

2. The car of claim 1 wherein each platform comprises a center sill and lateral bolsters connected to the center sill adjacent either end, the outer retention means being mounted near the ends of the bolsters.

3. The car of claim 2 wherein the platforms having additional retention means further comprise a cross-bearer connected to the center sill intermediate the outer retention means, the additional retention means being mounted near the ends of the cross-bearer.

4. The car of claim 1 wherein the platforms having additional retention means comprise a center sill and a cross-bearer connected to the center sill intermediate the outer retention means, the additional retention means being mounted near the ends of the cross-bearer.

5. The car of claim 4 wherein the cross-bearer is located half way between the outer retention means.

6. The car of claim 1 having five platforms and wherein three of the platforms have additional container retention means.

7. The car of claim 1 wherein the outer container retention means are positioned to support containers having securement fittings at the position of securement fittings of forty-foot containers.

8. The car of claim 7 wherein the position of the outer container retention means is such as to retain the opposite ends of two 20 foot containers positioned longitudinally end-to-end in closely spaced relation and the additional container retention means are positioned to support securement fittings of the adjacent ends of the twenty-foot containers.

9. The car of claim 1 wherein the outer retention means are locking devices.

10. The car of claim 2 further comprising container floor safety means attached to each platform for preventing container lading from falling to the track in the event of a container floor failure, the container floor safety means extending transversely of the center sill and having a width which is substantially equal to the width of the containers and positioned such that the container floor is normally retained in spaced relation thereto when containers are disposed on the container retention means.

11. The car of claim 3 wherein the center sill, lateral bolsters and cross-bearers, on platforms having cross-bearers, comprise the primary car structure, and further comprising container floor safety means attached to the primary car structure of each platform for preventing container lading from falling to the track in the event of a container floor failure, the container floor safety means extending transversely of the center sill and having a width which is substantially equal to the width of the containers and positioned such that the container floor is normally retained in spaced relation thereto when containers are disposed on the container retention means.

12. The car of claim 11 wherein the container floor safety means comprises a plurality of cross-ties connected to the center sill and longitudinal stringers connecting the outer ends of the cross-ties.

13. The car of claim 12 wherein the cross-ties are sized such that the width between stringers is no less than six and a half feet.

14. The car of claim 12 wherein the cross-ties are spaced such that there are no openings between the center sill, adjacent cross-ties and stringers greater than eight square feet in area.

15. A flat car for carrying containers having a primary car structure comprising a center sill, a lateral bolster connected to the center sill adjacent each end thereof, and container retention means mounted at the outer ends of the lateral bolsters, the primary car structure defining at least one platform supported on trucks, and container floor safety means connected to the primary car structure for preventing container lading from falling to the track in the event of a container floor failure, the container floor safety means extending transversely of the center sill and having a width which is substantially equal to the width of the containers and positioned such that the container floor is normally retained in spaced relation thereto when containers are disposed on the container retention means.

16. The car of claim 15 wherein the container floor safety means comprises a plurality of cross-ties connected to the center sill and longitudinal stringers connecting the outer ends of the cross-ties.

17. The car of claim 16 wherein the cross-ties are sized such that the width between stringers is no less than six and a half feet.

18. The car of claim 16 wherein the cross-ties are spaced such that there are no openings between the center sill, adjacent cross-ties and stringers greater than eight square feet in area.

19. A method of optimizing the loading of long and short containers on a multiple-platform, articulated container flat car without overloading its shared trucks, comprising the steps of:

providing outer container retention means adjacent the ends of all platforms;

providing additional container retention means intermediate the outer retention means only on alternate platforms;

placing one long container or two short containers on said alternate platforms; and placing long containers on the remaining platforms.

20. The method of claim 19 further characterized in that the flat car platforms comprise a primary car structure including a center sill and end bolsters attached to the sill, and further comprising the step of providing a container floor safety means connected to the primary car structure for preventing container lading from falling to the track in the event of a container floor failure, the container floor safety means extending transversely of the center sill and having a width which is substantially equal to the width of the containers.

21. An articulated flat car for carrying lading containers at a single level comprising at least first and second platforms supported at one end by trucks and at the other end by an articulated connection at a shared truck, both of said first and second platforms having outer container retention means positioned adjacent opposite ends thereof, and only one of said platforms having additional container retention means fixedly attached intermediate said outer container retention means.

22. An articulated flat car for carrying lading containers at a single level comprising at least first and second adjacent platforms supported at their outer ends by trucks and at their adjacent ends by an articulated connected at a shared truck, both of said platforms having container retention means fixedly mounted thereon and arranged such that only two short containers can be loaded on the first platform and only one container containers of a second, different load-carrying capacity can be loaded on the second platform.

* * * * *